US006595795B2

(12) United States Patent
Nakamura

(10) Patent No.: US 6,595,795 B2
(45) Date of Patent: Jul. 22, 2003

(54) CONNECTOR AND A METHOD OF ASSEMBLING A CONNECTOR

(75) Inventor: Hideto Nakamura, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 10/035,063

(22) Filed: Dec. 27, 2001

(65) Prior Publication Data

US 2002/0115339 A1 Aug. 22, 2002

(30) Foreign Application Priority Data

Feb. 16, 2001 (JP) ..... 2001-040822
Apr. 26, 2001 (JP) ..... 2001-129191

(51) Int. Cl.[7] ..... H01R 3/00
(52) U.S. Cl. ..... 439/489; 439/352
(58) Field of Search ..... 439/489, 488, 439/188, 352, 354

(56) References Cited

U.S. PATENT DOCUMENTS 5,370,543 A * 12/1994 Hamada et al. ..... 439/188
6,135,802 A 10/2000 Nakamura ..... 439/188
6,241,547 B1 6/2001 Fukuda ..... 439/352
6,341,974 B1 * 1/2002 Konoya ..... 439/352

FOREIGN PATENT DOCUMENTS

| | | |
|---|---|---|
| DE | 197 14 459 | 10/1998 |
| EP | 0 583 056 | 2/1994 |
| EP | 0 841 724 | 5/1998 |
| EP | 0 994 532 | 4/2000 |

* cited by examiner

*Primary Examiner*—P. Austin Bradley
*Assistant Examiner*—Alexander Gilman
(74) *Attorney, Agent, or Firm*—Gerald E. Hespos; Anthony J. Casella

(57) ABSTRACT

A connector with male and female housings (10, 30) is capable of detecting a partial connection both during a connecting operation and during a separating operation. The male housing (10) has a receptacle (11) and a lock arm (18) projects into a receptacle (11). The lock arm (18) is resiliently deformable between an engaging position where it is engageable with a slider (51) assembled into the female housing (30) and a disengaging position where it is disengaged from the slider (51). Coil springs (50) in the female housing (30) urge the slider (51) toward the male housing (10). If a connecting or separating operation is interrupted halfway the coil springs (50) push the slider (51) to forcibly separate the housings (10, 30) from each other.

10 Claims, 10 Drawing Sheets

CONNECTOR AND A METHOD OF ASSEMBLING A CONNECTOR

BACKGROUND OF THE INVENTION

1. Field of the Invention

The present invention relates to a connector and an assembling method for assembling a connector provided with a connection detecting function.

2. Description of the Related Art

A connector with a connection detecting function is disclosed in U.S. Pat. No. 6,135,802 and also is shown in FIG. 12 herein. The connector of FIG. 12 has a female housing 1 and a male housing 2 that can be connected with each other. A lock arm 3 is formed on the female housing 1 and is configured to engage the male housing 2 as the housings 1 and 2 are being connected. A slider 4 and a coil spring 4 are mounted in the male housing 2 and are disposed so that the coil spring 5 biases the slider 4 forwardly. The lock arm 3 deforms resiliently when the housings 1, 2 are being connected with each other and pushes the slider 4 rearwardly against the biasing force of the coil spring 5. The lock arm 3 is restored resiliently to its original shape when the housings 1 and 2 are connected properly to lock the housings 1, 2 into each other. However, the biasing force of the coil spring 5 returns the slider 4 to its initial position upon disengagement of the slider 4 from the lock arm 3.

The connection process could be interrupted with the housings 1, 2 only partly connected. In this situation, the coil spring 5 pushes the slider 4 forwardly, and the slider 4, in turn, pushes the lock arm 3 in a direction to separate the housings 1, 2 from each other. This separating movement provides an indication that the housings 1, 2 were left only partly connected.

The housings 1, 2 may have to be detached from each other for maintenance. Disconnection is achieved by resiliently deforming the lock arm 3 and then pulling the female housing 1 in a disconnecting direction. However, disconnection may be interrupted, and the housings 1, 2 may be left only partly connected during a separating operation.

Partial connection of the housings during the separating operation cannot be detected in conventional connectors. Hence, a demand exists for connectors capable of making such a detection.

The present invention was developed in view of the above situation and an object thereof is to enable a partial connection detection both during a connecting operation and during a separating operation.

SUMMARY OF THE INVENTION

The invention is directed to a connector with first and second housings that are connectable with each other. A slider is assembled in the first housing and is movable forward and backward along connecting and separating directions of the housings. A biasing means may be provided in the first housing for biasing the slider forwardly. An engaging portion is provided in the second housing and is resiliently or elastically displaceable between a first position and a second position where the housings are connected.

The slider is engaged with the engaging portion when the engaging portion is in the first position. The slider is moved away from the second housing against the biasing force of the biasing means both at an intermediate stage of a connecting operation and at an intermediate stage of separating the connector housings.

The engaging portion is displaced resiliently to the second position and is disengaged from the slider when the housings are connected properly with each other. The slider then is moved forward or toward the second housing by the release of the biasing force accumulated in the biasing means.

The slider preferably comprises an operable portion for moving the slider away from the second connector housing against the force of the biasing means to a position where displacement of the resiliently engaging portion to the first position is permitted.

The operable portion preferably is spaced from a leading end of the second connector housing when the first connector housing is connected properly with the second connector housing.

Accordingly, at the intermediate stage of the connecting operation, the slider is pushed by the resilient engaging portion in the engaging position and is moved back against the biasing force of the slider. The connecting operation could be interrupted at this stage. If the biasing force of the biasing means is released, the forwardly biased slider pushes the resiliently engaging portion to separate the connector housings forcibly. As a result, partial connection can be detected. When the connector housings are connected properly with each other, the resilient engaging portion is disengaged from the slider. Thus, the biasing force accumulated in the biasing means is released and the slider is moved forward.

The connected housings are separated by moving the slider back against the biasing force of the biasing means. If the separating operation is interrupted halfway, the slider is biased forward, by the release of the biasing force accumulated in the biasing means, and engages the resilient engaging portion that was displaced resiliently from the disengaging position to the engaging position to separate the housings forcibly. As a result, partial connection can be detected.

Thus, partial connection can be detected both during the connecting operation and during the separating operation.

The slider must be able to move back against the biasing force of the biasing means when the housings are to be separated. Thus, the operable portion is spaced back from the leading end of the other connector housing with the housings properly connected with each other. With such a construction, the operable portion is not covered by the other housing, and can be operated without interfering with the other housing. In the case that the operable portion is covered by the other housing, it is necessary to form the operable portion must bulge out to project from the other housing. However, with the subject invention, the operable portion can be made smaller by as much as the thickness of the other housing, thereby enabling the connector to be smaller. Further, a space is provided between an end of the operable portion and the leading end of the other connector housing. Therefore, the operable portion can be pulled by placing finger at the end of the operable portion toward the other connector housing. Thus, the operability of the slider can be improved further improved.

Two operable portions preferably are provided at substantially symmetrical positions of the slider. Accordingly, the slider can be operated easily by gripping and pulling the two operable portions.

The slider preferably comprises a wire accommodating portion to substantially cover the rear surfaces of the cavities in the first housing and to accommodate the terminal fittings. The wire accommodating portion is formed with wire accommodating holes that communicates with the respective cavities, and the side surface or the opposite side surfaces of the wire accommodating portion preferably serve as the operable portion. Accordingly, the connector can be made smaller since a portion of the slider where the operable portion(s) is/are formed also serves as part of the connector housing.

The resiliently engaging portion may be displaceable resiliently in a direction intersecting with the connecting and separating directions.

The resilient engaging portion preferably is provided in a receptacle of the second housing into which the first housing is at least partly insertable.

According to the invention, there is further provided a method of assembling a connector having at least one pair of housings at least partly connectable with each other. The method comprises connecting a first housing with a second housing to bring a resilient engaging portion in the second housing into engagement with a portion of the first housing to displace the resilient engaging portion from a second position where it is not engageable with the slider along connecting and separating directions of the housings to a first position where it preferably is engageable with the slider along the connecting and separating directions.

According to a preferred method, the slider engaged with the resilient engaging portion in the first position is moved back both at an intermediate stage of a connecting operation and at an intermediate stage of a separating operation, and/or when the connector housings are connected properly with each other, the engaging portion is displaced resiliently to the second position and is not engageable with the slider along the connecting and separating directions. Accordingly, the slider is moved forward.

Preferably, the method further comprises moving the slider away from the second connector housing against a biasing force of a biasing means, to a position where a displacement of the resilient engaging portion to the first position is permitted, by manipulating an operable portion of the slider.

These and other objects, features and advantages of the present invention will become more apparent upon reading of the following detailed description of preferred embodiments and accompanying drawings. It should be understood that even though embodiments are separately described, single features thereof may be combined to additional embodiments.

DETAILED DESCRIPTION OF THE PREFERRED EMBODIMENTS

A connector in accordance with the invention is comprised of a male connector housing 10 and a female connector housing 30 that are connectable to one another, as shown in FIG. 6. In the following description, ends of the housings 10, 30 to be connected with each other are referred to as the fronts.

Figure 1:
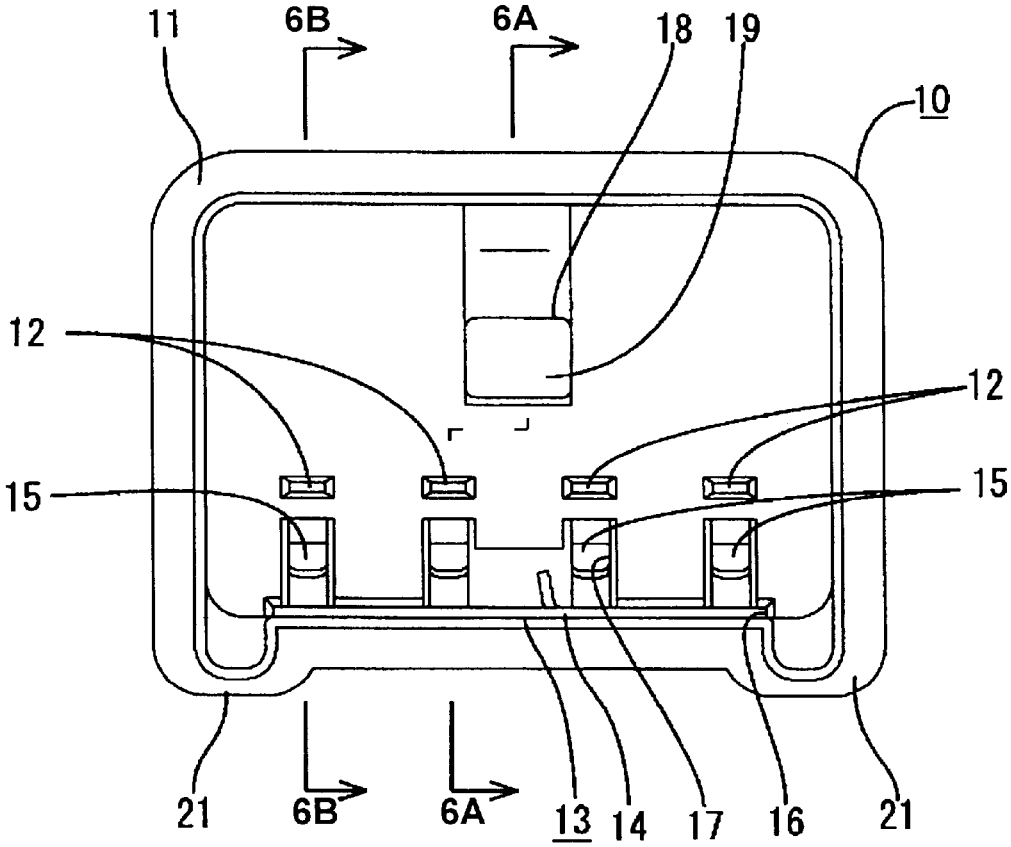
FIG. 1 is a front view of a male housing according to one embodiment of the invention.
Figure 2:
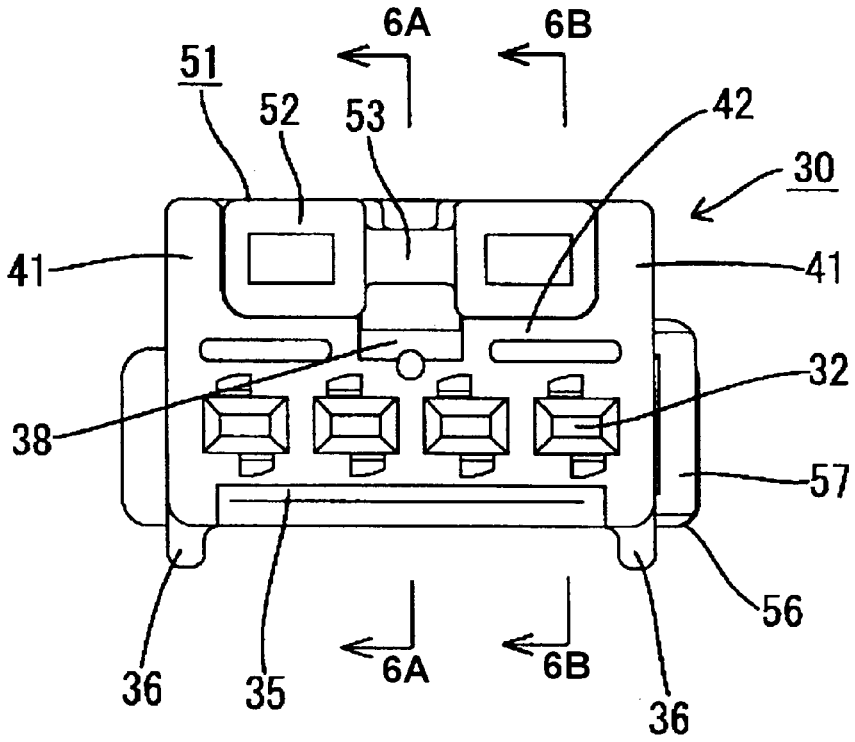
FIG. 2 is a front view of a female housing according to the embodiment of the invention.
Figure 3:
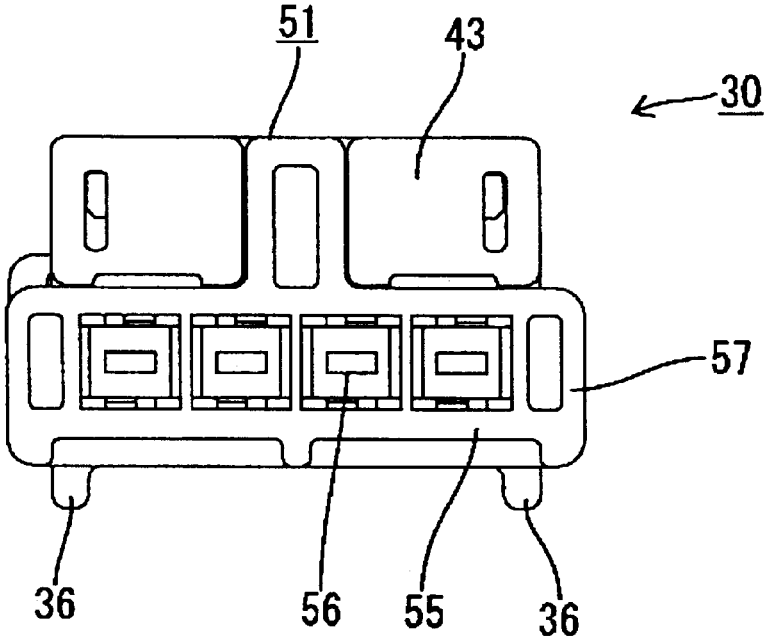
FIG. 3 is a rear view of the female housing.

The male housing 10 is formed of a synthetic resin, and has a substantially rectangular tubular receptacle 11 that projects forward from a piece of equipment, as shown in FIGS. 1 and 6. The female housing 30 can be fit into the receptacle 11 from the front so that the receptacle 11 covers about two-thirds of the front side of the female housing 30 when the housings 10, 30 are connected.

Four male tab terminals 12 are arranged substantially side by side and project from a back wall of the male housing 10. More or fewer male tab terminals 12 may be provided in other embodiments. The male tab terminals 12 project into the receptacle 11 and are electrically connectable with female terminal fittings 31 of the female housing 30. A shorting terminal 13 is accommodated in the back wall of the male housing 10 at a location below the male tab terminals 12. The shorting terminal 13 has a plate-shaped main portion 14 pressed into a mount groove 16 that is flush with the inner surface of the receptacle 11. Four resilient contact pieces 15 are folded at the rear end of the main portion 14 and project substantially forward. The resilient contact pieces 15 are accommodated in recesses 17 that face the respective male tab terminals 12, and are held resiliently in contact with the respective male tab terminals 12. Thus, the male tab terminals 12 are shorted with each other and no potential difference exists among the male tab terminals 12. The resilient contact pieces 15 are arranged so that their front ends project into the receptacle 11 and their leading ends are bent down. The contact pieces 15 are pushed resiliently away from the male tab terminals 12 as the female housing 30 is fitted into the receptacle 11.

A lock arm 18 is cantilevered to project forward from a widthwise center position of the back wall of the male housing 10 and is disposed on a side of the male tab terminals 12 opposite the shorting terminals 13. The lock arm 18 projects slightly more forward than the male tab terminals 12, and is resiliently deflectable about its rear end in a displacement direction D. The displacement direction D intersects a connecting and separating direction CSD at an angle, and preferably a substantially right angle. A hook 19 projects from the front end of the lock arm 18 and has a rearwardly facing locking surface 20 for engaging a corresponding surface on the female housing 30 to lock the fitted housings 10, 30 together.

Two guide recesses 21 are formed at substantially opposite sides of the bottom of the receptacle 11 for receiving guide ribs 36 of the female housing 30.

As shown in FIGS. 2 to 5, the female housing 30 is formed e.g. of a synthetic resin and defines a substantially block shape. Four cavities 32 are formed substantially side-by-side and penetrate longitudinally through the female housing 30 in positions that align with the mating male tab terminals 12. The cavities 32 accommodate female terminal fittings 31 connected with ends of wires W. A retainer mount hole 33 is formed in one side of the female housing 30 and crosses the cavities 32. A retainer 34 is mounted in the retainer mount hole 33 and projects into the respective cavities 32 to lock the female terminal fittings 31. Engaging recesses 35 are formed in the bottom surface of the female housing 30 and are engageable with the respective resilient contact pieces 15 of the shorting terminal 13 in the male housing 10. The resilient contact pieces 15 have engaging surfaces 15*a* that slant down and away from the male tab terminals 12 so that the resilient contact pieces 15 can be deformed smoothly downward. Guide ribs 36 project down at opposite side ends of the bottom of the female housing 30 and guide the connection of the housings 10, 30 by entering the guide recesses 22 of the male housing 10.

Figure 9A:
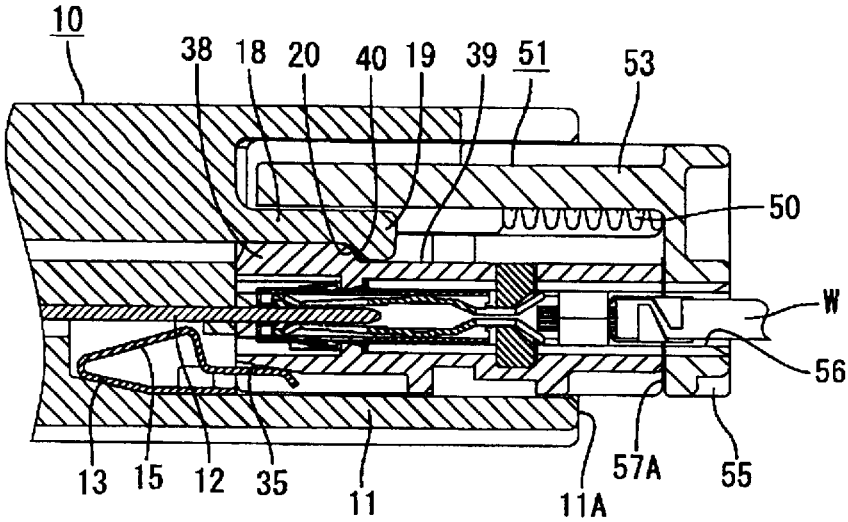
FIGS. 9A and 9B are sections along 6A—6A, 6B—6B showing a state where the housings are properly connected, respectively.

A bulging portion 38 is formed in the widthwise center of the upper surface of the female housing 30 and bulges up to the height of the lower surface of the lock arm 18 of the male housing 10. An escape groove 39 is formed behind the bulging portion 38 and extends back or away from the male connector housing 10. The escape groove 39 permits the entrance of the hook 19 of the lock arm 18. The rear end of the bulging portion 38 defines a locking surface 40 that is engaged by the locking surface 20 of the hook 19 of the lock arm 18 when the housings 10, 30 are connected properly (see FIG. 9). The locking surface 20 of the hook 19 and the locking surface 40 of the bulging portion 38 are sloped moderately upward to the left in the FIGURES, thereby forming a releasable locking construction. A specified force to separate the housings 10, 30 causes the hook 19 and the bulging portion 38 to cooperate. Thus, the lock arm 18 automatically is deformed resiliently upward and is guided from the locked state by the slanted locking surfaces 20, 40.

Figure 4:
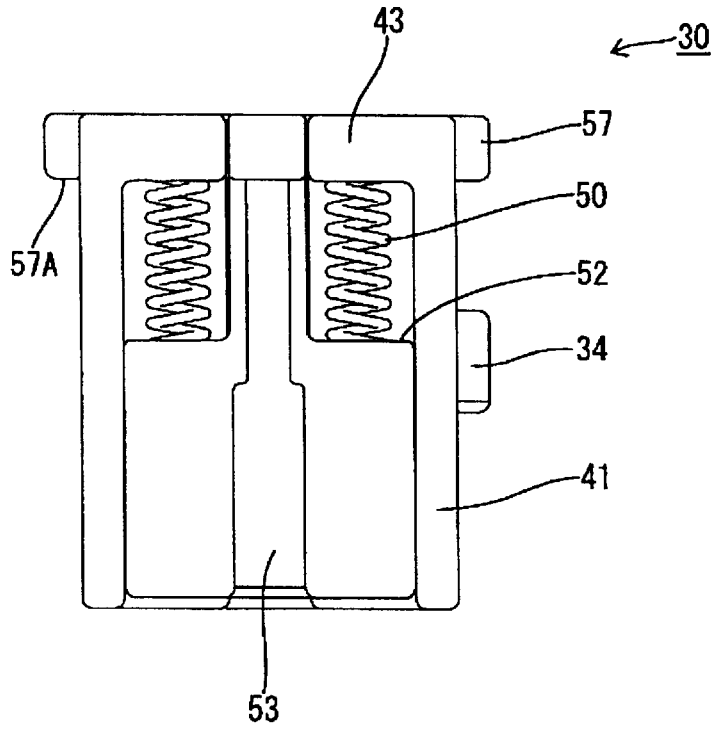
FIG. 4 is a plan view of the female housing.

An upper wall 42 of the female housing 30 extends back toward the rear end of the female housing 30, and side walls 41 extend upward. A rear wall 43 extends in the widthwise direction at the rear end of the upper wall 42 and connects the opposite side walls 41. Compression coil springs 50 are mounted from front on the upper surface of the female housing 30 and are surrounded by portions of the opposite side walls 41 and the rear wall 43, as shown in FIG. 4. A slider 51 is movable along the connecting and separating direction CSD of the housings 10, 30 and is guided by the upper wall 42 of the female housing 30, the opposite side edges of the bulging portion 38 and the opposite side walls 41. The slider 51 is biased forwardly by the springs 50.

A notch is formed in the widthwise middle of an extending portion of the upper wall 42 and the rear wall 43. The notch communicates with a space below the extending portion to form a receiving recess 45 for at least partly receiving a wire accommodating portion 55 of the slider 51.

Figure 5:
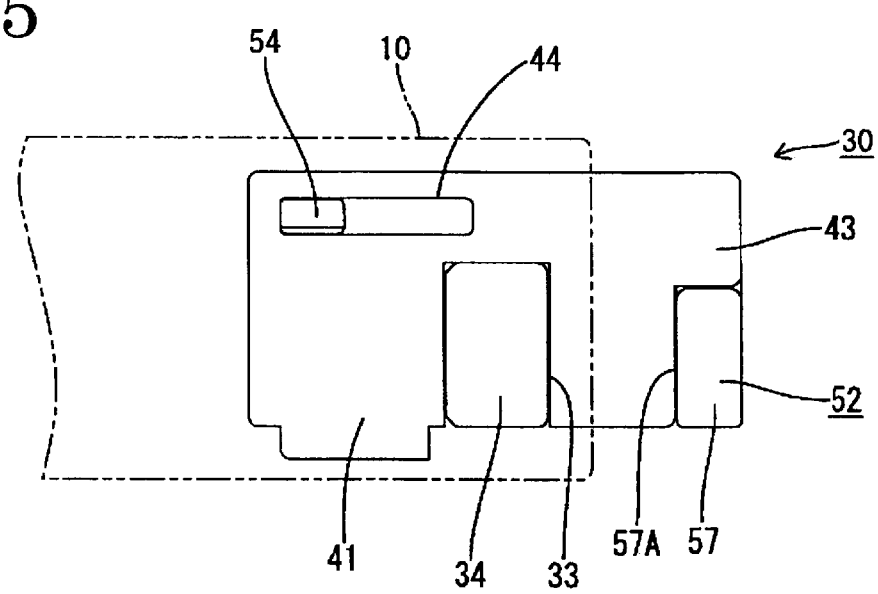
FIG. 5 is a side view of the female housing.
Figures 6A, 6B:
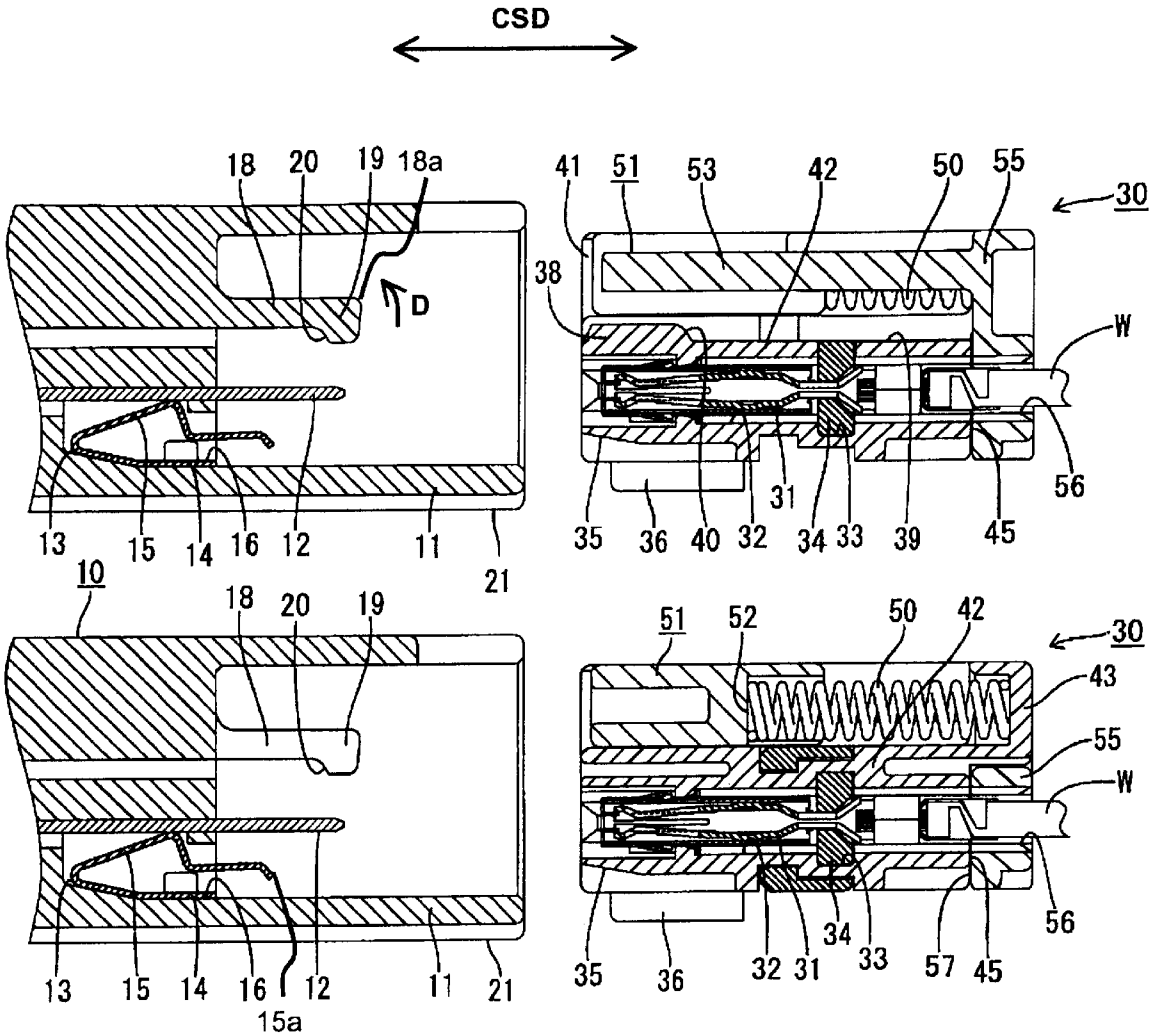
FIGS. 6A and 6B are sections along 6A—6A, 6B—6B showing a state before the housings are connected, respectively.

The slider 51 is formed e.g. of a synthetic resin and has spring accommodating portions 52 at its opposite sides for accommodating two compression coil springs 50. A centrally disposed coupling portion 53 bridges the spring accommodating portions 52. As shown in FIG. 6(B), the rear ends of the spring accommodating portions 52 are recessed to accommodate the compression coil springs 50. The spring accommodating portions 52 compress the coil springs 50 slightly along a longitudinal direction between the rear surfaces of the spring accommodating portions 52 and the front end surface of the rear wall 43. Rearward movement of the slider 51 resiliently deforms the compression coil springs 50 while storing even larger spring forces (see FIGS. 8(B) and 10(B)). Two stopper projections 54 project sideways from the opposite sides of the slider 51, as shown in FIG. 5. The front end surface of slider 51 is stopped at its limit position which is slightly retracted from the front end surface of the female housing 30 by introducing the stopper projections 54 into stopper grooves 44 in the side walls 41 and bringing the slider 51 into engagement with the front end surfaces of the stopper grooves 44. Thus, a range of movement of the slider 51 is limited by the stopper projections 54 and the stopper grooves 44.

Figure 7A:
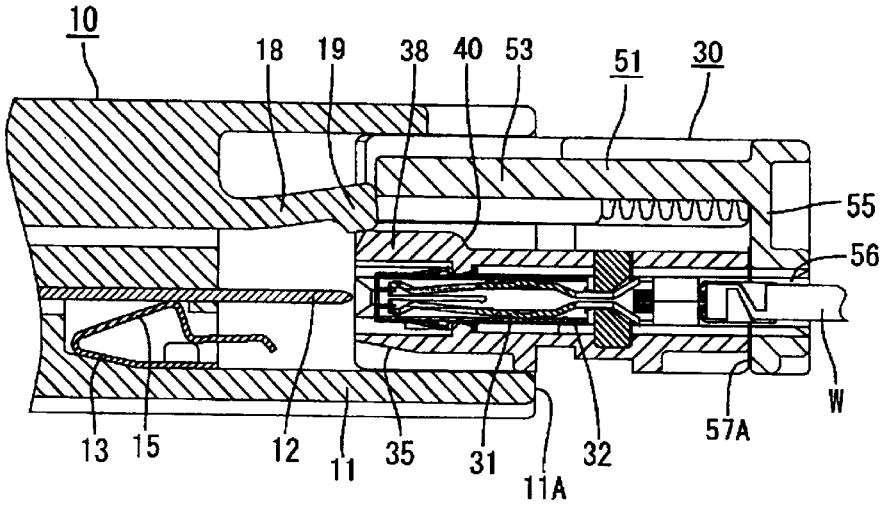
FIGS. 7A and 7B are a section along 6A—6A showing a state where a lock arm is resiliently deformed to engage a slider, and a section along 6B—6B showing a state at an intermediate stage of connection of the housings, respectively.

The coupling portion 53 of the slider 51 has a lower surface substantially at the same height as the upper surface of the lock arm 18 in its undeflected state, as shown in FIG. 6(A). Accordingly, the front end surface of the lock arm 18 is engageable with the front end surface of the coupling portion 53 when the lock arm 18 is deformed resiliently upward. The position of the lock arm 18 at this time is referred to as an engaging or first position (see FIG. 7(A)). On the other hand, the position of the lock arm 18 where it is in its natural state and cannot be engaged with the front end surface of the coupling portion 53 of the slider 51 is referred to as a disengaging or second position. The coupling portion 53 of the slider 51 is above the lock arm 18 substantially over its entire length when the housings 10, 30 are connected with each other. Thus, the coupling portion 53 of the slider 51 can prevent the lock arm 18 engaged with the bulging portion 38 from being resiliently deformed upward (see FIG. 9(A)).

The rear end of the coupling portion 53 extends up to the rear wall 43 of the female housing 30, and the wire-accommodating portion 55 is formed at its rear end. The wire-accommodating portion 55 has an inverted T-shape and can be fit at least partly into the receiving recess 45 of the female housing 30. A horizontal portion of the T-shaped wire-accommodating portion 55 covers the rear surfaces of all the cavities 32 and is formed with wire accommodating holes 56 at positions substantially corresponding to the respective cavities 32. The holes 56 communicate with the cavities 32 and the wires W are insertable therethrough. The opposite ends of this horizontal portion project slightly outward from the opposite side walls 41 of the female housing 30 and to define operable portions 57. Part of the slider 51 defines the wire-accommodating portion 55 of the female housing 30 and opposite side surfaces of the wire-accommodating portion 55 define the operable portions 57. Thus, the connector can be made smaller.

The operable portions 57 are provided at the rear end of the female housing 30 and are backward from a leading end 11A of the receptacle 11 when the housings 10, 30 are connected. Thus, a space is provided between front ends 57A of the operable portions 57 and the leading end 11A of the receptacle 11 to ensure operability. Simultaneously, fingers can be placed on the operable portions 57 even though the operable portions 57 do not bulge out significantly. This also makes the connector smaller.

Figure 7B:
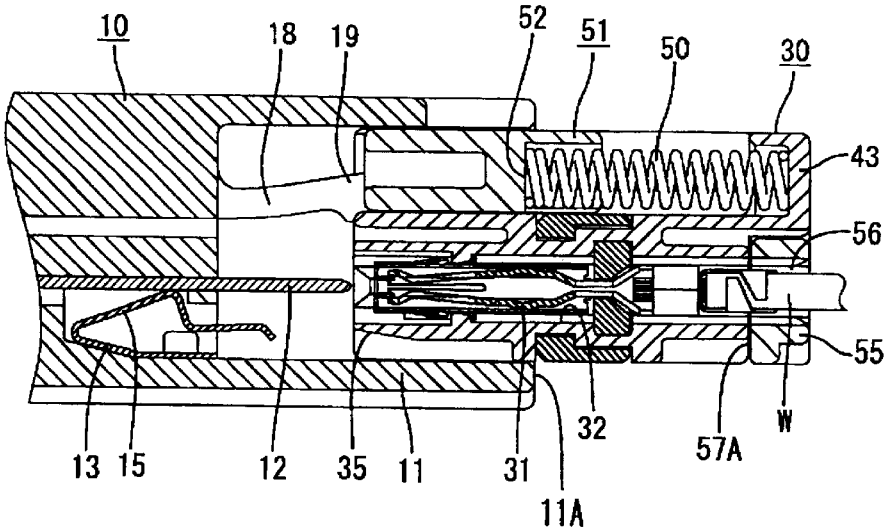

The housings 10, 30 are connected with each other by first aligning the male and female housing with one another, as shown in FIG. 6, and then fitting the female housing 30 into the receptacle 11 of the male housing 10. The lock arm 18 engages the front end surface of the bulging portion 38 and is deformed resiliently to the engaging or first position. Thus, the lock arm 18 moves onto the upper surface of the bulging portion 38, as shown in FIG. 7, before the male tab terminals 12 enter the cavities 32 of the female housing 30.

Figure 8A:
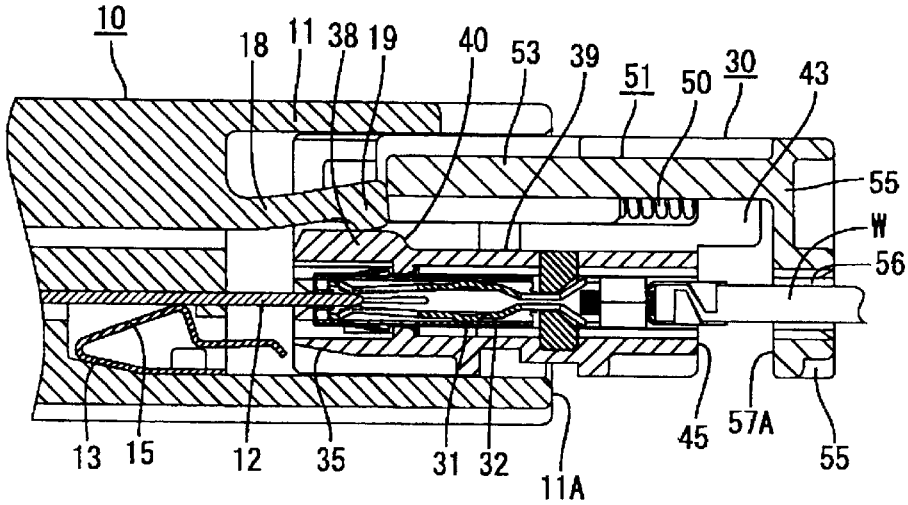
FIGS. 8A and 8B are a section along 6A—6A showing a state where the slider is moved backward by being pushed by the lock arm, and a section along 6B—6B showing a state where compression coil springs are resiliently compressed, respectively.
Figure 8B:
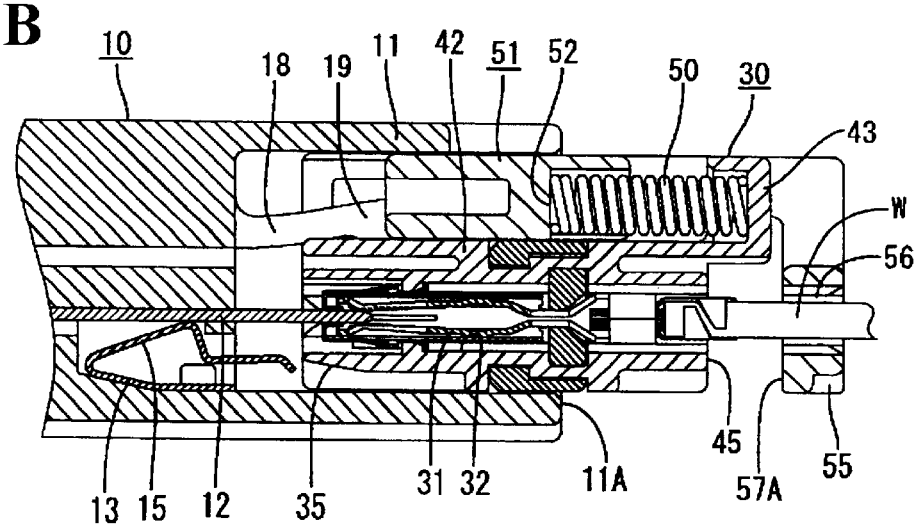

The front end surface of the lock arm 18 then is engaged with the front end surface of the coupling portion 53 of the slider 51 at a position slightly retracted from the front end surface of the bulging portion 38. If connection proceeds further from this state, the terminal fittings 12, 31 start contacting and the lock arm 18 pushes the slider 51 back, as shown in FIG. 8. As a result, the compression coil springs 50 are compressed.

The connecting operation may be interrupted halfway. In such a case, the spring forces accumulated in the resiliently compressed coil springs 50 are released, and the forwardly biased slider 51 pushes the lock arm 18 to forcibly separate the housings 10, 30 from each other. This prevents the housings 10, 30 from being kept partly connected.

Figure 9B:
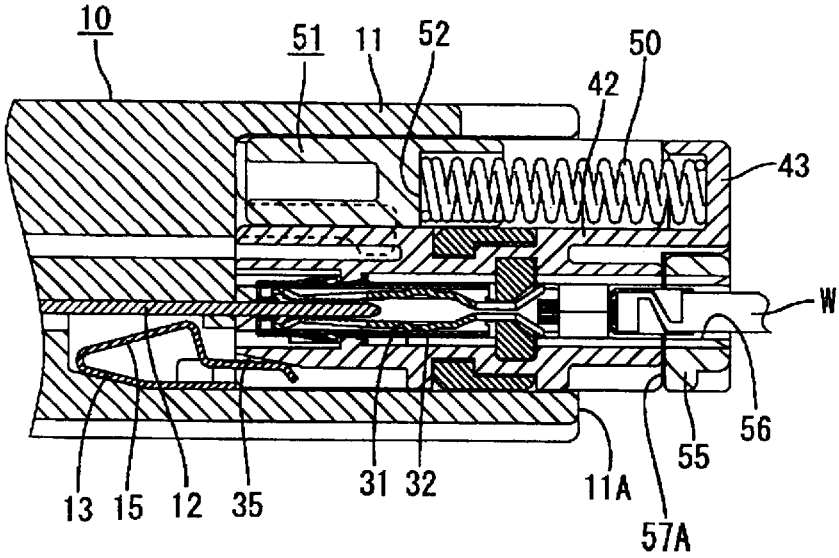

A continuation of the connecting operation causes the engaging recesses 35 of the female housing 30 to engage the respective resilient contact pieces 15 of the shorting terminal 13 to resiliently deform the resilient contact pieces 15 down and away from the male tab terminal 12, as shown in FIG. 9. As a result, the shorted state of the respective male tab terminals 12 is canceled. The hook 19 enters the escape groove 39 when the housing 30 is fitted into the housing 10 to the proper depth. The lock arm 18 then is restored resiliently to its disengaging or second position, and the locking surface 20 of the hook 19 engages the locking surface 40 of the bulging portion 38. Simultaneously, the slider 51 becomes disengaged from the lock arm 18 and is moved forward by the released spring forces accumulated in the compression coil springs 50. The slider 51 is stopped at the position it was at before the housings 10, 30 were connected by contact between the stopper projections 54 and the front end surfaces of the stopper grooves 44. At this time, the coupling portion 53 of the slider 51 covers the lock arm 18 substantially over its entire length and prevents the lock arm 18 from being resiliently deformed upward. In this way, the lock arm 18 and the bulging portion 38 are engaged and the slider 51 prevents the lock arm 18 from being deformed resiliently in the unlocking direction. Thus, the housings 10, 30 are locked firmly into each other and are inseparable from each other. Accordingly, the engagement of the lock arm 18 with the slider 51 prevents an unlocking of the connector housings 10, 20.

The housings 10, 30 may require separation for maintenance or another reason. In such a case, the slider 51 is moved back by pushing the operable portions 57 to compress the coil springs 50.

The operable portions 57 are spaced back from the leading end 11A of the receptacle 11 with the housings 10, 30 connected with each other. Thus, the receptacle 11 is prevented from getting caught by fingers placed on the operable portions 57. Further, a space is provided between the front ends 57A of the operable portions 57 and the leading end 11A of the receptacle 11. Thus, the female housing 30 easily can be moved back by placing fingers on the front ends of the operable portions 57 and pulling the operable portions 57 backward. Furthermore, the provision of two operable portions 57 on the opposite side walls of the wire accommodating portion 55 facilitates the gripping and movement of the female housing 30.

Figure 10A:
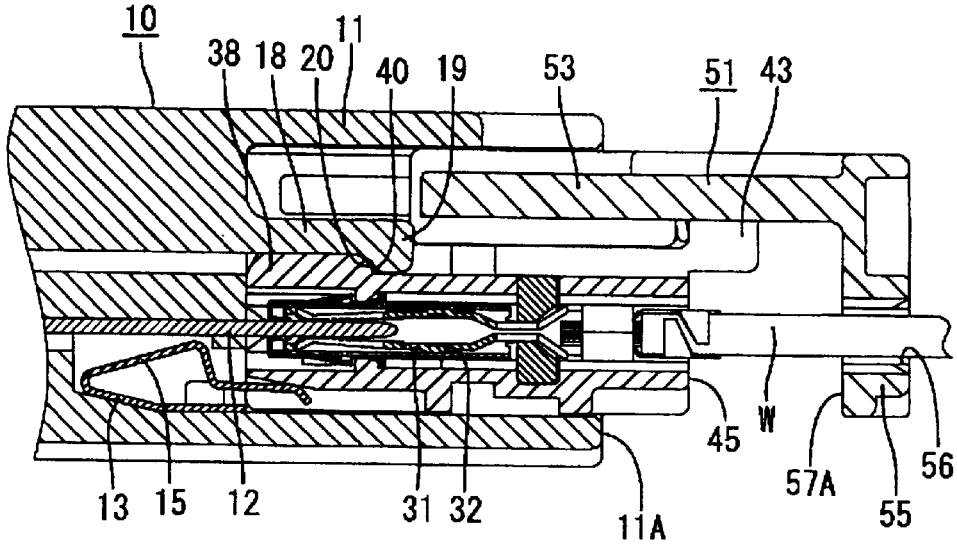
FIGS. 10A and 10B are a section along 6A—6A showing a state where the slider is moved backward, and a section along 6B—6B showing a state where the compression coil springs are resiliently compressed, respectively.
Figure 10B:
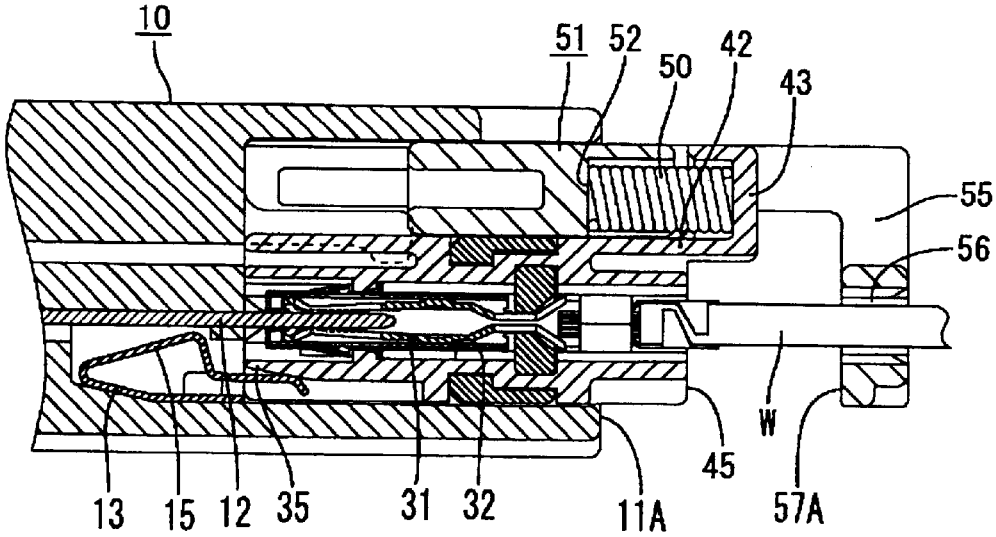
Figure 11A:
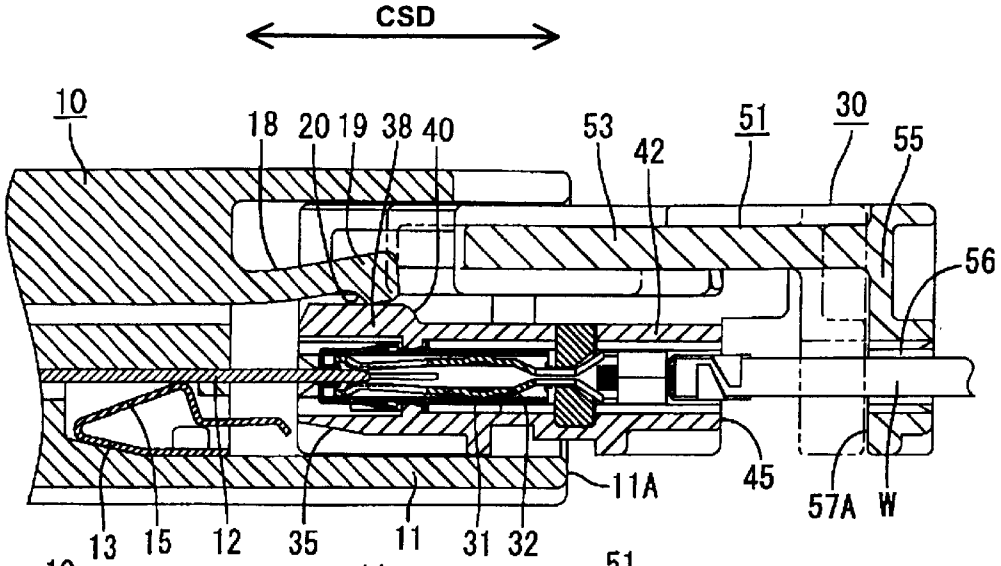
FIGS. 11A and 11B are sections along 6A—6A, 6B—6B showing an intermediate stage of separation, respectively.
Figure 11B:
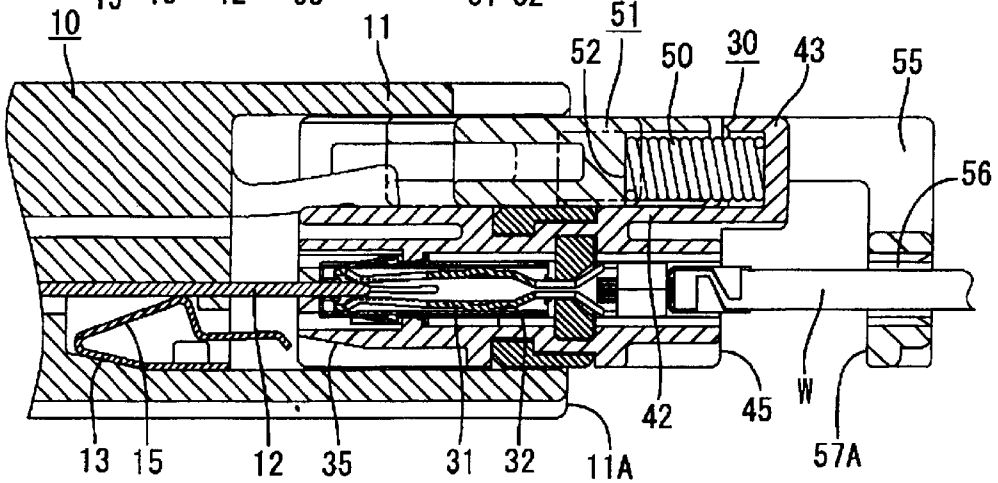
Figure 12:
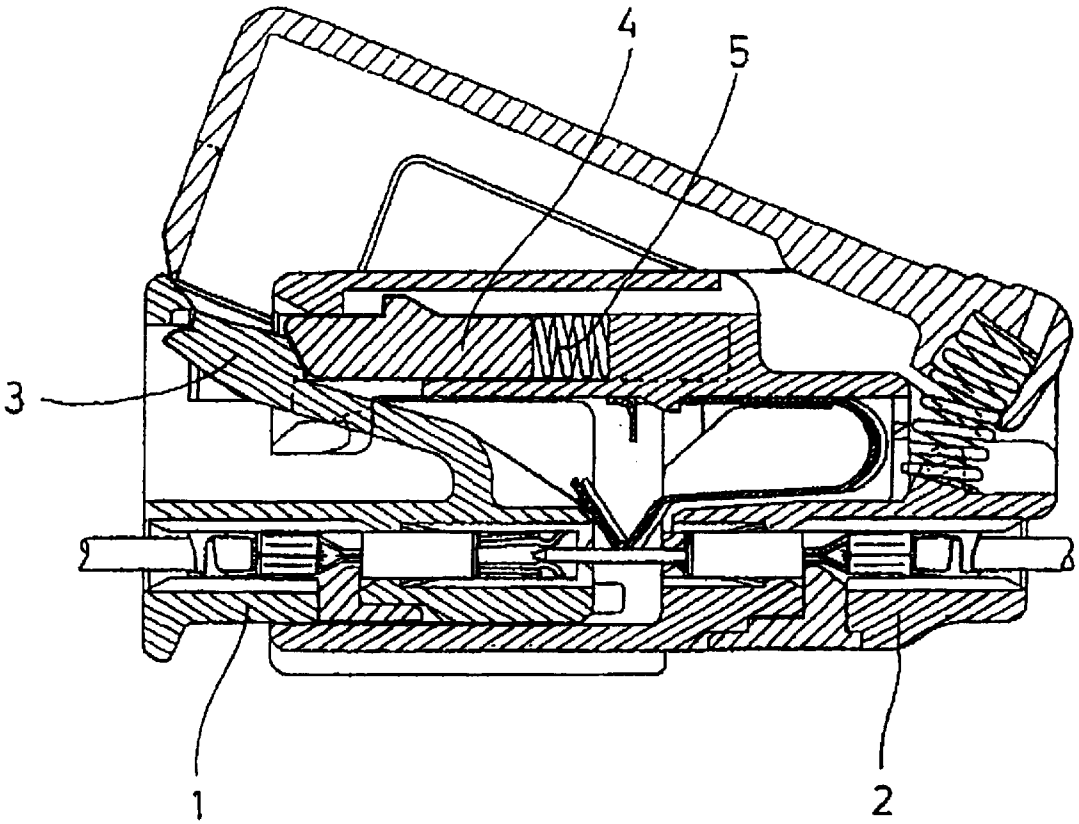
FIG. 12 PRIOR ART
FIG. 12 is a side view in section of a prior art connector.

The above-described manipulation of the operable portions 57 moves the coupling portion 53 of the slider 51 back to a position where it is no longer above the lock arm 18, as shown in FIG. 10. A further rearward movement of the operable portions 57 causes the slider 51 to compress the coil springs 50 and pushes the rear wall 43 of the female housing 30. As a result, the entire female housing 30 is pulled back. This pulling force causes the slanted locking surface 20 of the lock arm 18 to slide against the slanted locking surface 40 of the bulging portion 38. Thus, the lock arm 18 deforms resiliently upward in an unlocking direction. In other words, the unlocking of the lock arm 18 is possible because the lock arm 18 no longer is hindered by or abuts the slider 51. The locking surfaces 20, 40 of the hook 19 and the bulging portion 38 disengage when the female housing 30 is moved away from the male housing 10, as shown in FIG. 11. The respective resilient contact pieces 15 of the shorting terminal 13 are disengaged from the engaging recesses 35 and brought resiliently into contact with the respective male tab terminals 12 during this process. At this time, the separating operation can be performed easily since the operating direction of the slider 51 coincides with the separating direction of the female housing 30.

The separating operation may also be interrupted halfway. In such a case, the spring forces accumulated in the resiliently compressed coil springs 50 are released. Thus, the slider 51 moves forward and strikes against the front end surface of the lock arm 18 in the engaging or first position, as indicated in phantom in FIG. 11. As a result, the housings 10, 30 are separated forcibly from each other. On the other hand, the slider 51 will be biased by the compression coil springs 50 to strike against a rounded portion 18*a* at the upper front end of the lock arm 18 when the separating operation is interrupted with the female housing 30 moved slightly in separating direction from its connected state with the male housing 10 and with the lock arm 18 slightly resiliently deformed. Thus, the lock arm 18 is guided to its disengaging position and the housings 10, 30 are returned to the connected state. In such a case, the separating operation is performed again. In this way, the housings 10, 30 are prevented from being left partly connected during the separating operation.

As described above, partial connection of the housings 10, 30 can be detected either during a connecting operation or a separating operation. Further, the operable portions 57 are spaced back from the leading end 11A of the receptacle 11. Thus, fingers placed on the operable portions 57 will not catch the receptacle 11. Additionally, a space is provided between the front ends 57A of the operable portions 57 and the leading end 11A of the receptacle 11. Consequently, the female housing 30 easily can be moved back by placing fingers on the front ends 57 and pulling the operable portions 57 backward. Furthermore, the provision of two operable portions 57 on the opposite side walls of the wire accommodating portion 55, enables the female housing 30 to be moved back easily by gripping the operable portions 57.

The connector can be made smaller because part of the slider 51 serves as the wire accommodating portion 55 that forms part of the female housing 30 and the opposite side surfaces of the wire accommodating portion 55 serve as the operable portions 57.

The present invention is not limited to the above described and illustrated embodiment. For example, a following embodiment is also embraced by the technical scope of the present invention as defined in the claims. Beside the following embodiments, various changes can be made without departing from the scope and spirit of the present invention as defined in the claims.

In the foregoing embodiment, the slider 51 and the compression coil springs 50 are mounted in the female housing 30 and the lock arm 18 is provided in the male housing 10. Contrary to this arrangement, the slider and the biasing means may be provided in the male housing and the resiliently engaging portion may be provided in the female housing.

What is claimed is:

1. A connector having at least first and second connector housings, the housings having front ends that are at least partly connectable with each other, comprising:

a resilient engaging portion provided in the second connector housing and displaceable between a first position and a second position where the housings are substantially connected;

a slider assembled in the first connector housing and movable forward and backward along connecting and separating directions of the connector housings, the slider having a pair of operable portions provided at substantially symmetrical positions of the slider for moving the slider away from the second connector housing to a position where a displacement of the resilient engaging portion to the first position is permitted, the operable portions being at positions spaced from a leading end of the second connector housing with the first connector housing properly connected with the second connector housing; and a biasing means for biasing the slider forwardly along the connecting and separating directions, wherein the slider engaged with the resilient engaging portion located in the first position is moved away from the second connector housing, against the biasing force of the biasing means, both at an intermediate stage of an operation of connecting the connector housings and at an intermediate stage of an operation of separating the connector housings, and wherein, when the connector housings are connected properly with each other, the resilient engaging portion is disengaged from the slider by being resiliently displaced to the second position and the slider is moved forward by release of the biasing force accumulated in the biasing means.

2. A connector having at least first and second connector housings at least partly connectable with each other, comprising:

a slider assembled in the first connector housing and movable forward and backward along connecting and separating directions of the connector housings, the slider comprising a wire accommodating portion which is adapted to substantially cover rear surfaces of cavities formed in the first connector housing to at least partly accommodate terminal fittings and is formed with wire accommodating holes communicating with the corresponding cavities; and a resilient engaging portion provided in the second connector housing and displaceable between a first position and a second position where the housings are substantially connected.

3. The connector of claim 2, wherein at least one side surface of the wire accommodating portion defines an operable portion for moving the slider away from the second connector housing.

4. The connector of claim 2, wherein the resilient engaging portion is resiliently displaceable in a direction intersecting with the connecting and separating directions.

5. The connector of claim 2, wherein the resilient engaging portion is provided in a receptacle of the second housing into which the fist housing is at least partly insertable.

6. A connector comprising:

a first housing having opposite front and rear ends, a plurality of first terminal fittings mounted in the first housing, a bulging portion being formed on an external surface of the first housing in proximity to the front end, a locking surface facing rearwardly on the bulging portion;

a second housing having a front end and a receptacle extending into the front end, the receptacle being configured to receive at least the front end of the first housing therein, a plurality of second terminal fittings mounted in the second housing, the second terminal fittings being disposed for engagement with the first terminal fittings when the front end of the first housing is received in the receptacle, a resilient engaging portion projecting forwardly in the receptacle and disposed to be engaged by said bulging portion and deflected away from the plurality of second terminal fittings during insertion of the first housing into the receptacle, the resilient engaging portion further being configured to return toward the plurality of second terminal fittings and to an undeflected condition and engage the locking surface of the bulging portion after complete insertion of the first housing into the receptacle;

a slider assembled in the first housing for movement between front and rear positions, the slider being configured to prevent deflection of the resilient engaging portion away from the locking surface when the slider is in the front position; and first and second biasing means extending between the slider and the first housing and disposed on opposite respective sides of the bulging portion of the first housing for biasing the slider toward the front position.

7. The connector of claim 6, wherein the bulging portion is configured to deflect said resilient engaging portion into engagement with the slider during insertion of the first housing into the receptacle, such that the resilient engaging portion pushes the slider toward the rear position.

8. The connector of claim 7, wherein the slider further comprises at least one operable portion projecting therefrom to enable manual urging of the slider to the rear position for permitting deflection of the resilient engaging portion away from the locking surface and enabling separation of the first and second housings.

9. The connector of claim 6, wherein the resilient engaging portion comprises a single resiliently deflectable lock arm disposed substantially symmetrically with respect to the plurality of second terminal fittings.

10. The connector of claim 9, wherein the first and second biasing means comprise first and second coil springs disposed symmetrically on opposite respective sides of the lock arm when the connector housings are connected properly.

* * * * *